US011603243B2

(12) United States Patent
Takigawa

(10) Patent No.: US 11,603,243 B2
(45) Date of Patent: Mar. 14, 2023

(54) PACKAGING POUCH

(71) Applicant: Takigawa Corporation Japan, Chiba (JP)

(72) Inventor: Hiroyuki Takigawa, Chiba (JP)

(73) Assignee: Takigawa Corporation Japan, Funabashi (JP)

( * ) Notice: Subject to any disclaimer, the term of this patent is extended or adjusted under 35 U.S.C. 154(b) by 0 days.

(21) Appl. No.: 17/298,373

(22) PCT Filed: Nov. 26, 2019

(86) PCT No.: PCT/IB2019/060179
§ 371 (c)(1),
(2) Date: May 28, 2021

(87) PCT Pub. No.: WO2020/115612
PCT Pub. Date: Jun. 11, 2020

(65) Prior Publication Data

US 2022/0002057 A1 Jan. 6, 2022

(30) Foreign Application Priority Data

Dec. 3, 2018 (DE) ..... 20 2018 106 857.1

(51) Int. Cl.
*B65D 75/00* (2006.01)
*B65D 75/58* (2006.01)
*B65D 33/25* (2006.01)

(52) U.S. Cl.
CPC ..... *B65D 75/5827* (2013.01); *B65D 33/2541* (2013.01); *B65D 75/5805* (2013.01); *B65D 2575/586* (2013.01)

(58) Field of Classification Search
CPC ..... B65D 75/5827; B65D 75/5805; B65D 2575/586; B65D 33/2541
(Continued)

(56) References Cited

U.S. PATENT DOCUMENTS 3,388,836 A * 6/1968 Otto ..... B65D 75/5805 222/541.9
4,332,327 A * 6/1982 Frohwerk ..... B65B 61/08 383/200
(Continued)

FOREIGN PATENT DOCUMENTS

DE 1949140 U 11/1966
DE 19951357 A1 5/2001
(Continued)

OTHER PUBLICATIONS

International Search Report dated Feb. 12, 2020 filed in PCT/IB2019/060179.

*Primary Examiner* — Peter N Helvey
(74) *Attorney, Agent, or Firm* — Rankin, Hill & Clark LLP

(57) ABSTRACT

A packaging bag made of flexible plastics material, in particular for packaging medical products, having at least two bag walls (2) and having at least two lateral edges (3), wherein the bag walls (2) are connected to one another along their edge (4) at least in some section or sections by means of at least one connecting seam (5), wherein a defined predetermined tear line (6), configured for controlled tearing open of the packaging bag (1), is provided, which extends from a tear-open starting point (7) of a first lateral edge (3*a*) in the direction (R) of a second lateral edge (3*b*), wherein the bag walls (2) are connected at the second lateral edge (3*b*) via a connecting seam (5), which has a leading edge (9) directed toward the first lateral edge (3*a*), and wherein a tear-stop arrangement (10) having a tear-stop leading edge (11), configured to stop tear propagation, is provided in the direction of extent (V) of the predetermined tear line (6), and wherein the tear-stop leading edge (11) is arranged ahead of the leading edge (9) of the connecting seam (5), and the leading edge (9) of the connecting seam (5) is arranged
(Continued)

Figure 1:
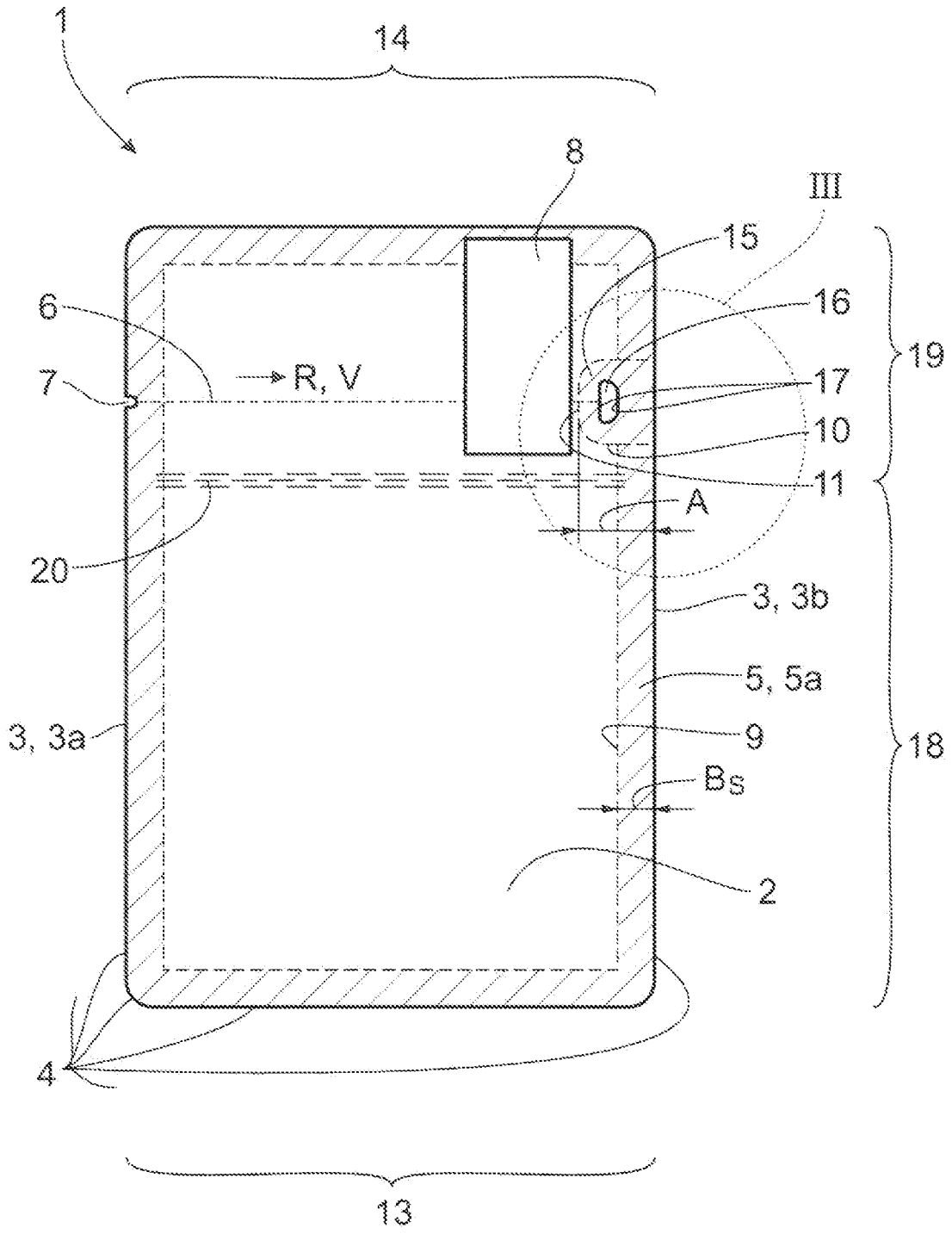

ahead of the second lateral edge (3*b*) in the direction of extent (V) of the predetermined tear line (6).

22 Claims, 4 Drawing Sheets

(58) Field of Classification Search
USPC ..... 383/204
See application file for complete search history.

(56) References Cited

U.S. PATENT DOCUMENTS 5,169,696 A * 12/1992 Lang ..... B32B 27/32 428/347
5,222,813 A * 6/1993 Kopp ..... B65D 75/5805 229/87.05
5,902,047 A * 5/1999 Yeager ..... B65D 33/2533 383/203
6,244,467 B1 * 6/2001 Lewit ..... B65D 55/16 222/541.6
6,702,462 B2 * 3/2004 Richardson ..... B65D 75/5811 222/541.6
6,773,163 B2 * 8/2004 Ichikawa ..... B29C 48/0255 24/585.12
D619,018 S * 7/2010 Karay ..... D9/702
7,891,875 B1 2/2011 Feldman
9,649,472 B2 * 5/2017 Kearns ..... B65D 75/5805
9,718,593 B2 * 8/2017 Gillespie ..... B65D 75/5866
9,988,197 B2 6/2018 Simonsen et al.
10,793,334 B2 * 10/2020 Asai ..... B65D 31/02
2001/0010737 A1 * 8/2001 Olin ..... B65D 33/2533 383/906
2001/0014187 A1 8/2001 Takahashi et al.
2003/0231811 A1 12/2003 Hodson et al.
2008/0233252 A1 * 9/2008 Manning ..... B65D 33/2508 426/106
2009/0266036 A1 10/2009 Zerfas et al.
2011/0064338 A1 * 3/2011 Surdziel ..... B65D 75/5816 383/207
2014/0334748 A1 11/2014 Sasaki et al.

FOREIGN PATENT DOCUMENTS

DE 10 2007 024 087 A1 10/2008
DE 202009002028 U1 9/2010
DE 10 2009 041 251 A1 3/2011
EP 1136379 A1 9/2001
JP 2002284192 A 10/2002
JP 2014101141 A 6/2014
JP 2016188094 A 11/2016
KR 20160149166 A 12/2016
WO 2018159509 A1 9/2018

* cited by examiner

PACKAGING POUCH

The invention relates to a packaging bag of flexible plastics material and to a packaging bag of flexible plastics material.

In this context, the packaging bag in question can correspond to any type of design of a packaging means in the form of a bag. These are, for example, flat bags, stand-up bags, gusseted bags or the like, which can, in particular, be designed as sealed-edge bags. To this extent, therefore, the term "packaging bag" should be interpreted broadly here.

For opening or tearing open a packaging bag, predetermined tear lines are nowadays often provided along the packaging. During the tear-open process along this predetermined tear line, the filling space is opened and the product located therein can be removed.

A packaging bag of this kind is known from DE 10 2007 024 087 A1. This packaging bag is used for packaging solid, powdered or granulated products, for example care, washing or cleaning products. The latter is designed as a tubular bag and has a filling space delimited by transversely directed closure seams. For opening the packaging bag and thus for possible removal of the product from the filling space, a predetermined tear line is provided here which runs from one outer edge of one closure seam to the outer edge of the other closure seam. When the packaging bag is opened or torn open, the induced tear thus runs from one edge to the opposite edge.

While the known packaging bag generally provides good tear-open behavior, the packaging bag is divided, during an opening process along the predetermined tear line, into two loose parts which are no longer connected to one another, irrespective of the expenditure of force.

One challenge here is the use of such a packaging bag for products for which a quality mark or closure mark, for example a revenue stamp, tax label or marking as a medical product, for example medicaments or medicinal cannabis and cannabinoid preparations, which is applied or glued to the packaging is prescribed by law. Such quality or closure marks should, in principle, be at least partially, in particular completely, severed when a package is opened. However, even after the packaging has been opened, the quality or closure marks should remain completely on the packaging.

The problem addressed by the invention is that of configuring and developing the known packaging bag in such a way that, when it is torn open, the quality mark or closure mark is reliably severed and, at the same time, the risk of a complete division of the packaging bag is reduced.

In the case of a packaging bag made of flexible plastics material, in particular for packaging medical products, the above problem is solved by having at least two bag walls and at least two lateral edges, wherein the bag walls are connected to one another along their edge at least in some section or sections by means of at least one connecting seam, wherein a defined predetermined tear line, configured for controlled tearing open of the packaging bag, is provided, which extends from a tear-open starting point of a first lateral edge in the direction of a second lateral edge, wherein the bag walls are connected at the second lateral edge via a connecting seam, which has a leading edge directed toward the first lateral edge, and a tear-stop arrangement having a tear-stop leading edge, configured to stop tear propagation, is provided in the direction of extent of the predetermined tear line, and the tear-stop leading edge is arranged ahead of the leading edge of the connecting seam, and the leading edge of the connecting seam is arranged ahead of the second lateral edge in the direction of extent of the predetermined tear line.

The solution according to the proposal is based, first of all, on the consideration that the predetermined tear line severs the quality mark or closure mark in a simple manner when tearing open. A further consideration is that stopping the tear induced along the predetermined tear line prevents or makes it more difficult to divide the packaging bag. At the same time, a predetermined tear line which is not continuous as far as the opposite edge promotes exclusively sectional opening of the packaging bag.

In detail, it is proposed that the bag walls be connected at the second lateral edge via a connecting seam, which has a leading edge directed toward the first lateral edge, and that a tear-stop arrangement having a tear-stop leading edge, configured to stop tear propagation, be provided in the direction of extent of the predetermined tear line, and that the tear-stop leading edge be arranged ahead of the leading edge of the connecting seam, and the leading edge of the connecting seam be arranged ahead of the lateral edge in the direction of extent of the predetermined tear line.

A packaging bag made of flexible plastics material is understood to mean that the packaging bag either consists entirely of plastics material or the bag walls consist at least substantially of plastics and/or have a plastics coating. For example, these may be single-layer or multilayer bag walls, which may also have a layer of an aluminum foil.

The predetermined tear line reduces the tear resistance during the opening process of the packaging bag and serves above all for the controlled opening of the packaging bag. The predetermined tear line can in this case be designed as a weakening of the material or as a material structure, in particular as a groove or perforation. Furthermore, it is also possible for the predetermined tear line to lie parallel to the extrusion direction of the at least one plastics layer or plastic-coated layer of the bag walls 2. It is possible, for example, for a desired weakening of the material to be produced even during extrusion, said weakening later forming the predetermined tear line. The predetermined tear line is preferably arranged orthogonally to the connecting seams.

When the packaging bag is opened or torn open, a tear is induced in the direction of a second lateral edge, starting from the tear-open starting point of the first lateral edge. This tear runs along the predetermined tear line and, in the case of correct use, i.e. when normal force is exerted, is stopped by the tear-stop arrangement according to the proposal with the tear-stop leading edge. A normal application of force is precisely the force which must be applied in order to induce the tear starting from the tear-open starting point. Owing to its configuration, the tear-stop arrangement ensures that the tear-stop leading edge stops the tear and this thus ends in the tear-stop arrangement. Owing to the geometric configuration of the tear-stop arrangement, it is not possible to continue the tear. Since the tear ends in the tear-stop arrangement and thus cannot be continued, sectional opening of the packaging bag is optimized and the division of the packaging bag is prevented.

In a particularly preferred embodiment, the bag walls are connected to one another along the first lateral edge and/or a packaging bag base and/or a packaging bag top via a connecting seam. The packaging bag base can be designed as a bottom seam and the packaging bag top can be designed as a top seam. This is advantageous insofar as it allows the packaging bag to be designed flexibly and as a function of the product to be packaged.

In principle, it is particularly advantageous if the connecting seam is a sealing seam. It is thereby possible to produce an airtight packaging bag in a particularly simple manner.

In the particularly preferred embodiment, the ratio of a width of the connecting seam of the second lateral edge to the distance of the tear-stop leading edge from the second lateral edge is at least 1, preferably at least 2, more preferably at least 2.5.

In this context, the width of the connecting seam of the second lateral edge is understood to mean the extent of the connecting seam in the direction from the first lateral edge to the second lateral edge. This ratio makes it possible to adapt the packaging bag to the purpose, the respective filling content, the size of the packaging bag and the assumed duration of use.

According to the preferred embodiment, the tear-stop arrangement is arranged at a distance from or adjoining or partially overlapping the connecting seam of the second lateral edge. This is advantageous insofar as it is possible to adapt the size of the opening to the purpose, the filling content, the size of the packaging bag and the duration of use.

In the particularly preferred embodiment, the tear-stop arrangement has at least one tear-stop sealing seam. The tear-stop sealing seam is understood to mean a sealing seam which at least partially, preferably completely, stops the tear as soon as the tear reaches it. In addition or as an alternative, the tear-stop arrangement can have at least one tear-stop hole. The tear-stop hole is an interruption in the tear-stop arrangement in the form of a hole. When the induced tear reaches the tear-stop hole, the hole stops the tear. In this arrangement, the tear-stop sealing seam and/or the at least one tear-stop hole are/is arranged in the course of the predetermined tear line. This is advantageous insofar as it allows the tear-stop arrangement to be adapted in a simple manner to the geometric configuration and the intended use of the packaging bag. Here, the tear-stop sealing seam can be formed by welding the bag walls to one another or by welding an additional layer of material to the bag walls. This additional layer of material can be arranged between the bag walls or on one of the outer sides.

The arrangement of a plurality of tear-stop holes can be advantageous, for example, if the predetermined tear line lies substantially perpendicular to the extrusion direction of the at least one plastics layer or plastic-coated layer of the bag walls. Furthermore, a plurality of tear-stop holes lying one behind the other can prevent the packaging bag from being divided with increased handling, for example transportation.

In the particularly preferred embodiment, the at least one tear-stop hole is arranged after the respective tear-stop sealing seam in the direction of extent of the predetermined tear line. In addition or as an alternative, the at least one tear-stop hole is arranged ahead of the respective tear-stop sealing seam in the direction of extent of the predetermined tear line.

According to a further preferred embodiment, the at least one tear-stop sealing seam at least partially, preferably completely, surrounds the tear-stop hole. In this case, the tear-stop sealing seam preferably forms a hole edge of the tear-stop hole. The end of the tear can thus be adapted to the assumed duration of use and the intended use, with the result that the tear reaches the tear-stop hole or the tear-stop sealing seam first.

In the particularly preferred embodiment, the tear-stop hole is round or oval or a polygon. In the case of a polygonal shape of the tear-stop hole, the corners are rounded at least at the hole edge facing the second lateral edge, and preferably all the corners of the polygon are rounded. Rounding the hole edge which faces the second lateral edge prevents the formation of a new tear and thus the division of the packaging bag.

In the preferred embodiment, the tear-stop starting point of one lateral edge has a weakening of the material, preferably a tear-open notch or a cut. In addition or as an alternative, the tear-stop starting point can have a marking. Such a weakening of the material or marking simplifies the opening process. Here, the weakening of the material or the marking can be triangular, parabolic, wavy or sawtoothed. In this case, the weakening of the material can be rectangular or can be designed as a round or V-notch.

The further preferred embodiment provides a product-receiving section and a top section. In this case, the predetermined tear line is located in the top section. The product-receiving section is the section of the packaging bag that receives the product. The top section adjoins the product-receiving section. When tearing open along the predetermined tear line, the top section is partially severed. The size of the product-receiving section and of the top section can be adapted depending on the respective product and intended use.

The further preferred embodiment provides a closure between the product-receiving section and the top section. The closure may be a pressure closure or an adhesive closure or a zip closure and/or a profile closure. In this case, it is particularly advantageous if the closure, in particular the zip closure, is child-proof.

In the particularly preferred embodiment, the tear-stop arrangement is arranged at least partially, preferably completely, in the top section.

According to a further teaching, which has independent significance, a further packaging bag made of flexible plastics material, in particular for packaging medical products, is claimed.

In the packaging bag according to the proposal, the second lateral edge has no connecting seam. Furthermore, provision is made, according to the proposal, for a tear-stop arrangement having a tear-stop leading edge, configured to stop tear propagation, to be provided in the direction of extent of the predetermined tear line. According to the proposal, the tear-stop leading edge is here arranged ahead of the second lateral edge in the direction of extent of the predetermined tear line. Reference may be made to all statements regarding the packaging bag according to the proposal.

Figure 2:
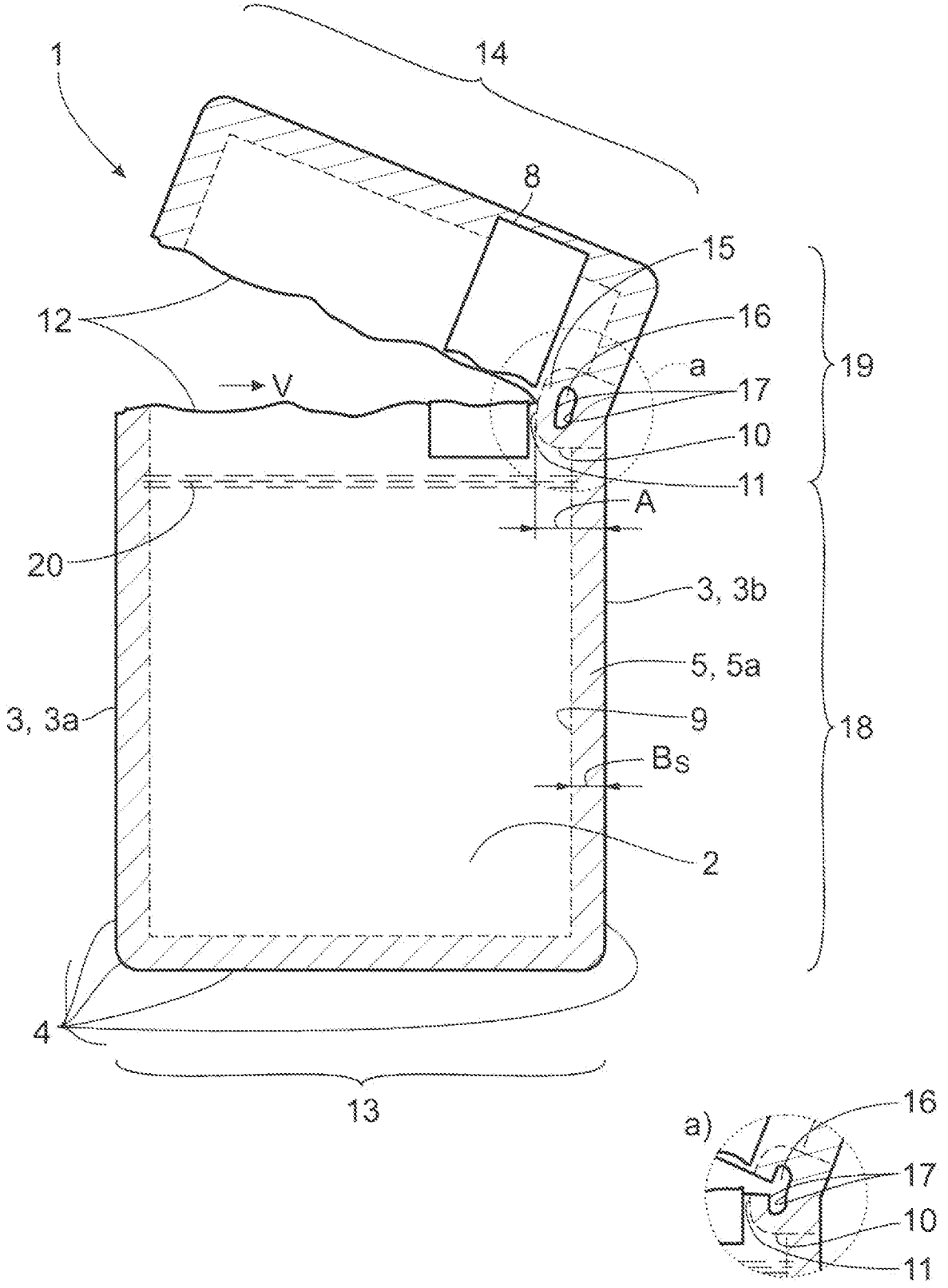
Figure 3:
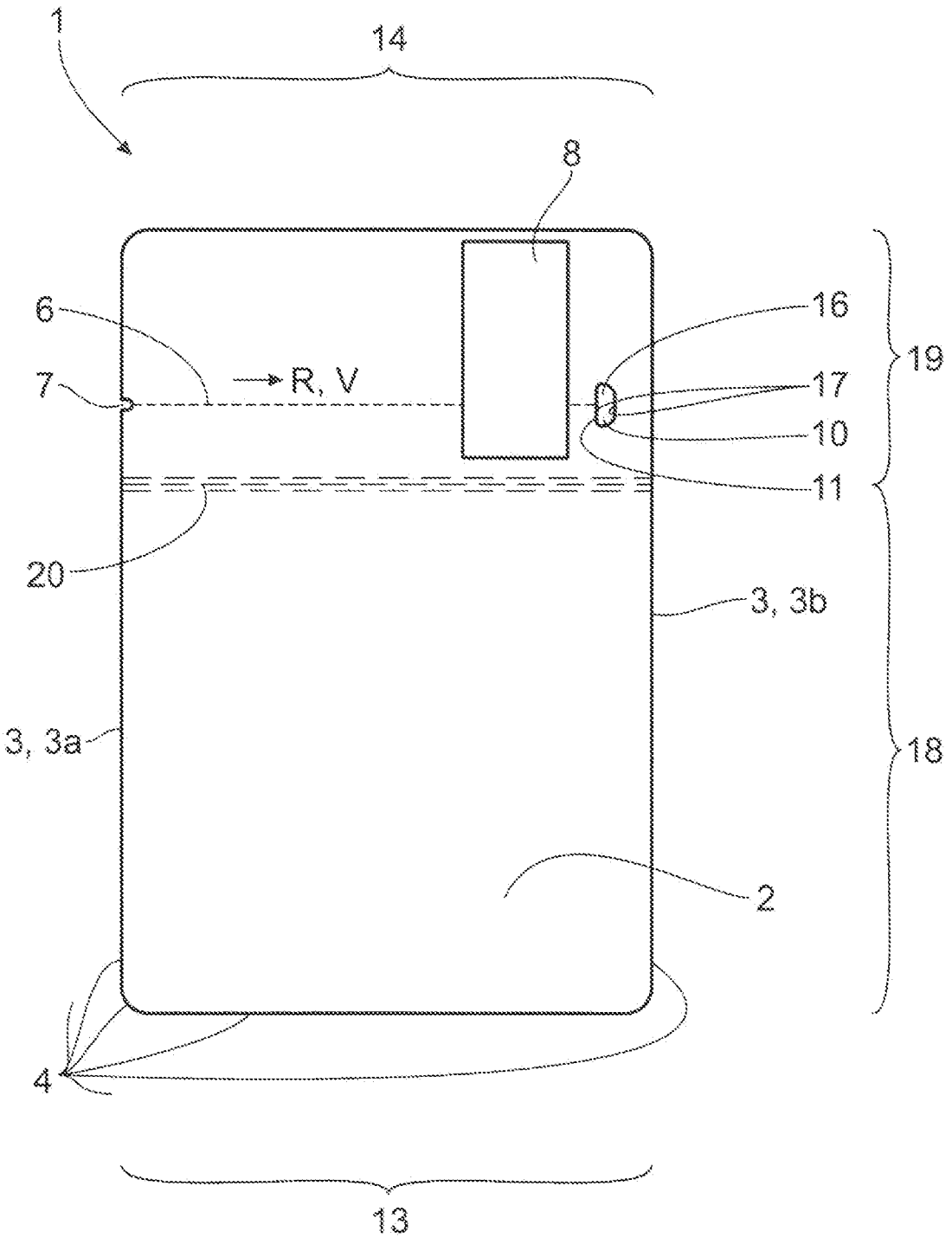
Figure 4:
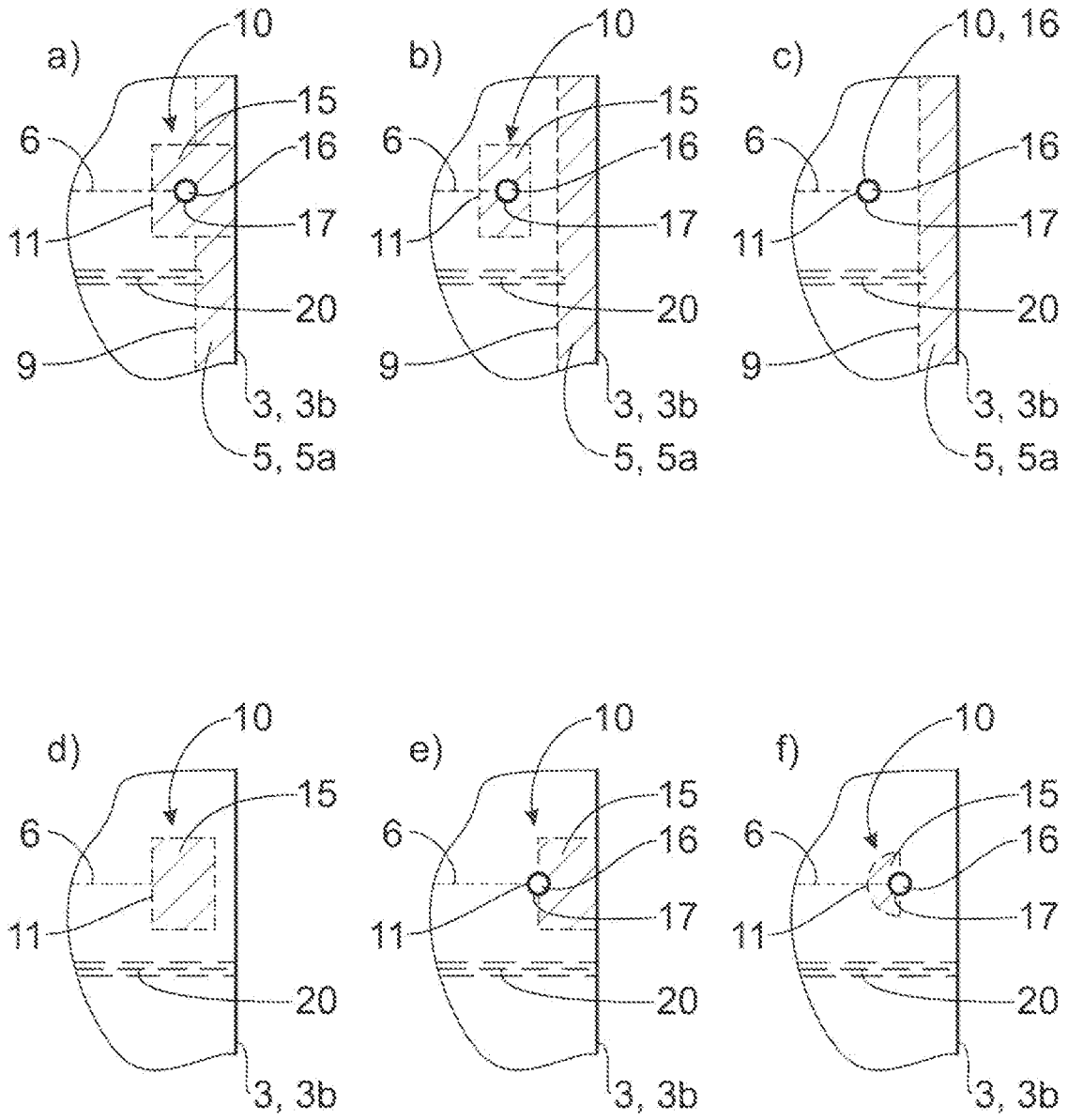

The invention is explained below with reference to a drawing, which illustrates just one exemplary embodiment. In the drawing:

FIG. 1 shows a first exemplary embodiment of a packaging bag according to the proposal with a tear-stop arrangement in the closed state, FIG. 2 shows the packaging bag according to FIG. 1 in the open or torn-open state, with the end of the tear at the tear-stop leading edge and in an enlarged detail with the end of the tear in the tear-stop hole, FIG. 3 shows a further exemplary embodiment of a packaging bag according to the proposal in the closed state, FIG. 4 shows the tear-stop arrangement in particularly preferred embodiments for the packaging bag according to the proposal.

The packaging bag 1 essentially has a tubular shape and can be configured, for example, as a flat bag, a stand-up bag or the like. The term packaging bag is to be understood broadly in the present case, as already explained in the introductory part of the description. All embodiments in this respect apply correspondingly to all other types of packaging bags 1.

FIG. 1 illustrates the packaging bag 1 made of flexible plastics material, in particular for packaging medical products. The packaging bag 1 has at least two bag walls 2 and at least two lateral edges 3. In this case, the bag walls 2 are connected to one another along their edge 4 at least in some section or sections by means of at least one connecting seam 5. For controlled tearing open of the packaging bag 1, a defined predetermined tear line 6 is provided in at least one of the bag walls 2, preferably in two mutually opposite bag walls 2. This predetermined tear line 6 extends from a tear-open starting point 7 at a first lateral edge 3*a* of the bag wall 2 and/or of the packaging bag 1 in the direction R of a second lateral edge 3*b* of the bag wall 2 and/or of the packaging bag 1. Here and for preference, the predetermined tear line 6 extends orthogonally to one of the two lateral edges 3*a*, 3*b*. The packaging bag 1 furthermore provides a glued-on closure mark 8, for example a revenue stamp, a tax label or a seal. The closure mark 8 is positioned, in particular positioned above the predetermined tear line 6, in such a way that it is severed or torn along the predetermined tear line 6 during the opening process.

It is essential for the teaching according to the proposal that the bag walls 2 are connected at least at the second lateral edge 3*b* via a connecting seam 5. In this case, the connecting seam 5 has a leading edge 9 directed toward the first lateral edge 3*a*. Furthermore, according to the proposal, a tear-stop arrangement 10 having a tear-stop leading edge 11 is provided in the direction of extent V of the predetermined tear line 6. A tear 12 formed during tearing open thus reaches the tear-stop leading edge 11 of the tear-stop arrangement 10 first. The tear-stop leading edge 11 is configured to stop propagation of the tear 12. Moreover, according to the proposal, the tear-stop leading edge 11 is arranged ahead of the leading edge 9 of the connecting seam 5, and the leading edge 9 of the connecting seam 5 is arranged ahead of the second lateral edge 3*b* in the direction of extent V of the predetermined tear line 11. The leading edge 9 of the connecting seam 5 is to be understood here to mean the inner edge of the connecting seam 5. Here and for preference, the leading edge 9 of the connecting seam 5 is arranged opposite the second lateral edge 3*b* of the connecting seam 5.

As already mentioned, the bag walls 2 may comprise a flexible plastics material. In this case, the bag walls 2 may consist at least substantially of plastics or have a plastics coating. For example, these may be single-layer or multilayer bag walls 2, which may also have a layer of an aluminum foil. In order to simplify the opening or tear-open process, the predetermined tear line 6 is provided. This reduces the tear-open resistance of the packaging bag 1 along a defined line, thereby ensuring controlled and defined opening of the packaging bag 1. The predetermined tear line 6 is in this case designed as a weakening of the material or as a material structure, in particular as a groove or perforation, in the respective bag wall 2. Furthermore, it is also possible for the predetermined tear line 6 to lie parallel to the extrusion direction of the at least one plastics layer or plastic-coated layer of the bag walls 2.

If a tear 12 is now induced at the tear-open starting point 7 during the opening process, this tear follows the course of the predetermined tear line 6 until it reaches the tear-stop leading edge 11, as illustrated in FIG. 2. If the packaging bag 1 is opened with great force or is frequently used, it can happen that the tear 12 extends beyond the tear-stop leading edge 11 and nevertheless ends in the tear-stop arrangement 10, as shown in FIG. 2*a*). FIG. 2 furthermore shows that the tear 12 does not continue after reaching the tear-stop arrangement 10, thus preventing division of the packaging bag 1. The closure mark 8 is severed in this process and remains completely connected to the packaging bag 1. On the one hand, this meets the legal requirements. On the other hand, the environment can be protected in addition since no part of the packaging bag enters the environment after the packaging bag has been opened.

In the illustrated variant of the packaging bag 1, the bag walls 2 are additionally connected to one another along the first lateral edge 3*a*, the packaging bag base 13 and the packaging bag top 14 via a connecting seam 5. This variant is particularly advantageous for the airtight packaging of products.

It is also conceivable in principle that the connecting seam 5 is a sealing seam 5*a*. Here, the plastics material of the two contacting layers is welded together at elevated pressure and temperature. Such a sealing seam 5*a* is particularly advantageous for packaging bags 1 for products which are intended to retain their aroma over a relatively long period of time.

For the design configuration of the packaging bag 1, it is particularly advantageous if the ratio of the width $B_S$ of the connecting seam 5 of the second lateral edge 3*b* to the distance A of the tear-stop leading edge 11 from the second lateral edge 3*b* is at least 1. It is particularly preferred if this ratio is at least 2, preferably at least 2.5. In this context, the width $B_S$ is understood to mean the extent of the connecting seam 5 in the direction from the first lateral edge 3*a* to the second lateral edge 3*b*. By way of this ratio, it is possible, on the one hand, to adapt the degree of opening of the packaging bag 1 and, on the other hand, the duration of use of the packaging bag 1 to the respective filling content or intended use.

Here and for preference, provision is made for the tear-stop arrangement 10 in the variants of the packaging bag 1 shown in FIGS. 1 to 3 to have at least one tear-stop sealing seam 15. In addition or as an alternative, the tear-stop arrangement 10 can have at least one tear-stop hole 16. This can already be provided in the bag walls 2 before production or can be punched in after production.

The tear-stop sealing seam 15 is arranged in the course of the predetermined tear line 6. In addition or as an alternative, the tear-stop hole 16 is also arranged in the course of the predetermined tear line 6. In this case, either the tear-stop sealing seam 15 or the tear-stop hole 16 has the tear-stop leading edge 11. Thus, either the tear-stop sealing seam 15 or the tear-stop hole 16 stops propagation of the tear 12. As a result, the tear-stop arrangement 10 can be adapted to the assumed duration of use or the intended use of the packaging bag 1.

In a variant not shown here, a plurality of tear-stop holes 16 is provided. These can be arranged at the same distance as one another from the second lateral edge 3*b*. This is particularly advantageous if the predetermined tear line 6 runs at an angle to the extrusion direction of the at least one plastics layer or plastic-coated layer of the bag walls 2. If it should happen that the tear 12 deviates somewhat from the defined predetermined tear line 6, the tear-stop holes 16 arranged one below the other, with or without the tear-stop sealing seam 15, can ensure that the tear 12 is stopped, whatever its course.

However, it is also conceivable for the tear-stop holes 16 to be arranged one behind the other at different distances from the second lateral edge 3*b*. This reduces the risk of the tear 12 continuing in the event of increased stress on the packaging bag, for example due to transportation of the packaging bag.

According to FIG. 4, numerous possibilities are conceivable for the structural arrangement of the tear-stop sealing seam 15 and of the tear-stop hole 16. For example, the at least one tear-stop hole 16 is arranged after the respective tear-stop sealing seam 15 in the direction of extent V of the predetermined tear line 6 (FIGS. 4*a*), *b*), *d*), *f*)). However, it is also conceivable for the at least one tear-stop hole 16 to be arranged ahead of the respective tear-stop sealing seam 15 in the direction of extent of the predetermined tear line 6 (FIG. 4*g*)).

Another variant of the packaging bag 1 envisages that the at least one tear-stop sealing seam 15 at least partially surrounds the tear-stop hole 16 (FIGS. 4*e*), *f*)). However, the variant in which the tear-stop sealing seam 15 completely surrounds the tear-stop hole 16 is preferred here (FIGS. 4*a*), *b*), *d*)). Here and for preference, the tear-stop sealing seam 15 forms the hole edge 17 of the tear-stop hole 16. By means of the arrangement of the tear-stop sealing seam 15 and of the tear-stop hole 16, it is in turn possible to influence the duration of use of the packaging bag 1 and its intended use. If the tear-stop hole 16 is completely surrounded by a tear-stop sealing seam 15, the risk of dividing the packaging bag 1 is minimized.

In a preferred variant of the packaging bag 1, the tear-stop hole 16 is round or oval or designed as a polygon. In the case of embodiment as a polygon, at least the corners at the hole edge 17 facing the second lateral edge 3*b* are rounded. Preferably, and as illustrated in FIGS. 1-3, all the corners of the polygon are rounded. Advantageously, the tear-stop hole 16 can be adapted here to the size of the packaging bag 1, its contents or further requirements on the sealing seam. Here and preferably afterwards, the tear-stop hole 16 is punched into the packaging bag 1 or is already provided during the production of the packaging bag 1. The provided roundings of the tear-stop hole 16 prevent the propagation of tears, on the one hand, and the formation of a new tear, on the other hand.

In order to be able to open the packaging bag 1 in a simple manner and without much effort, a weakening of the material, preferably a tear-open notch or a cut, is preferably provided at the tear-open starting point 7 of the first lateral edge 3*a*. In addition or as an alternative, the tear-open starting point 7 can have a marking. Here, the marking or the weakening of the material can be of rectangular, triangular, parabolic, wavy or sawtoothed configuration. As a particular preference, the weakening of the material is configured as a round notch or V-notch.

In a further variant, a product-receiving section 18 and a top section 19 are provided. In this case, the predetermined tear line 6 is located in the top section 19.

The solution according to the proposal has provided particularly good results when a closure 20 is provided between the product-receiving section 18 and the top section 19. Here and for preference, the closure 20 is designed as a zip closure. In addition or as an alternative, the closure 20 is configured as a profile closure. Configuration of the closure 20 as a pressure closure or adhesive closure is also conceivable.

The closure 20 serves above all for the reclosability of the product-receiving section 18. The use of a zip closure, also called a zipper, has proven to be particularly advantageous in this context since it can be opened and closed again easily and at the same time can be designed to be child-proof. A child-proof configuration provides a function or a mechanism which makes it possible to prevent or make more difficult interference with an object by, for example, children. It is intended to prevent a child from easily opening a bag with hazardous contents or a medication package, etc., for example. A child-proof zip closure can be produced, for example, by increasing the tightness of fit or the opening resistance or by making access to the zip closure more difficult. Thus, medical products can be stored safely and so as to be protected from environmental influences in a simple manner and at the same time cannot get into the hands of children.

Furthermore, it has proven useful for the tear-stop arrangement 10 to be arranged at least partially, preferably completely, in the top section 19.

In an alternative embodiment of the packaging bag 1 according to the proposal, as shown in FIG. 3, at least two bag walls 2 and at least two lateral edges 3 are likewise provided. In this variant too, the defined predetermined tear line 6 extends from the tear-open starting point 7 of the first lateral edge 3*a* in the direction R of the second lateral edge 3*b*. The essential point here is that the second lateral edge 3*b* has no connecting seam. According to the proposal, the tear-stop arrangement 10 is provided here with a tear-stop leading edge 11 in the direction of extent V of the predetermined tear line 6. As already mentioned, the tear-stop arrangement 10 serves to stop propagation of the tear 12. Another essential point here is that the tear-stop leading edge 11 is arranged ahead of the second lateral edge 3*b* in the direction of extent V of the predetermined tear line 6. Reference may be made to all statements regarding the packaging bag according to the proposal.

The invention claimed is:

1. A packaging bag made of flexible plastics material having a filling space for receiving a product, said packaging bag comprising:

at least two bag walls that are connected to one another along their edges at least in some section or sections by means of at least one connecting seam having an inner edge to which the filling space for the product adjoins; and at least a first lateral edge and a second lateral edge;

wherein a defined predetermined tear line for controlled opening of the packaging bag by tearing extends from a tear-open starting point of the first lateral edge in a tearing opening direction toward the second lateral edge, wherein at the second lateral edge the connecting seam has a leading edge facing toward the first lateral edge, said leading edge being the inner edge of the connecting seam to which the filling space for the product adjoins, wherein the at least two bag walls are additionally connected to one another along a packaging bag base and a packaging bag top via the connecting seam, wherein the predetermined tear line extends in the tearing opening direction to a tear-stop arrangement for stopping tear propagation, wherein the tear-stop arrangement includes a tear-stop leading edge that is arranged ahead of the leading edge of the connecting seam in the tearing opening direction, wherein the leading edge of the connecting seam is arranged ahead of the second lateral edge in the tearing opening direction, wherein the tear-stop arrangement is arranged adjoining or partially overlapping the connecting seam of the second lateral edge, and wherein the tear-stop arrangement is arranged at a distance transverse to the tearing opening direction of the tear line from the connecting seam of the packaging bag base and at a distance transverse to the tearing opening direction of the tear line from the connecting seam of the packaging bag top.

2. The packaging bag as claimed in claim 1, wherein the bag walls are connected to one another along the first lateral edge via the connecting seam.

3. The packaging bag as claimed in claim 1, wherein the connecting seam is a sealing seam.

4. The packaging bag as claimed in claim 1, wherein the ratio of the width of the connecting seam of the second lateral edge to the distance of the tear-stop leading edge from the second lateral edge is at least 1.

5. The packaging bag as claimed in claim 4, wherein the ratio is at least 2.

6. The packaging bag as claimed in claim 4, wherein the ratio is at least 2.5.

7. The packaging bag as claimed in claim 1, wherein the tear-stop arrangement has at least one tear-stop sealing seam arranged in the course of the predetermined tear line.

8. The packaging bag as claimed in claim 1, wherein the tear-stop arrangement has at least one tear-stop hole arranged in the course of the predetermined tear line.

9. The packaging bag as claimed in claim 1, wherein the tear-stop arrangement has at least one tear-stop sealing seam and at least one tear-stop hole arranged in the course of the predetermined tear line.

10. The packaging bag as claimed in claim 9, wherein the at least one tear-stop hole is arranged after the tear-stop sealing seam in the tearing opening direction.

11. The packaging bag as claimed in claim 7, wherein the at least one tear-stop sealing seam at least partially surrounds the tear-stop hole.

12. The packaging bag as claimed in claim 7, wherein the at least one tear-stop sealing seam completely surrounds the tear-stop hole.

13. The packaging bag as claimed in claim 9, wherein the tear-stop sealing seam forms a hole edge of the tear-stop hole.

14. The packaging bag as claimed in claim 1, wherein the tear-stop hole is round or oval or is a polygon with a rounded corner at least at the hole edge facing the second lateral edge.

15. The packaging bag as claimed in claim 14, wherein the tear-stop hole is rounded on all corners.

16. The packaging bag as claimed in claim 1, wherein the tear-open starting point of the first lateral edge has a weakening of the material.

17. The packaging bag as claimed in claim 16, wherein the weakening is one or more of a tear open notch, a cut and a marking.

18. The packaging bag as claimed in claim 1, wherein a product-receiving section and a top section are provided, and wherein the predetermined tear line is located in the top section.

19. The packaging bag as claimed in claim 18, wherein a closure is provided between the product-receiving section and the top section.

20. The packaging bag as claimed in claim 19, wherein the closure is selected from the group consisting of a pressure closure, an adhesive closure, a zip closure and a profile closure.

21. The packaging bag as claimed in claim 18, wherein the tear-stop arrangement is arranged at least partially in the top section.

22. The packaging bag as claimed in claim 18, wherein the tear-stop arrangement is arranged completely in the top section.

* * * * *